US009339854B2

(12) United States Patent
Chee et al.

(10) Patent No.: US 9,339,854 B2
(45) Date of Patent: May 17, 2016

(54) PIPELINE PIG BRUSH AND BRUSH ASSEMBLY

(71) Applicant: 766089 ALBERTA LTD., Calgary (CA)

(72) Inventors: Foong Weng Chee, Calgary (CA); Dolores Houghton, Calgary (CA); Michael Hooper, Chestermere (CA)

(73) Assignee: FIBERBUILT MANUFACTURING INC., Calgary (CA)

( * ) Notice: Subject to any disclaimer, the term of this patent is extended or adjusted under 35 U.S.C. 154(b) by 0 days.

(21) Appl. No.: 13/969,255

(22) Filed: Aug. 16, 2013

(65) Prior Publication Data

US 2014/0123417 A1 May 8, 2014

Related U.S. Application Data

(63) Continuation of application No. 12/946,656, filed on Nov. 15, 2010, now Pat. No. 8,534,768, which is a continuation of application No. 11/306,614, filed on Jan. 4, 2006, now abandoned, which is a continuation-in-part of application No. 10/710,214, filed on Jun. 24, 2004, now abandoned.

(51) Int. Cl.
*B08B 9/00* (2006.01)
*B08B 9/055* (2006.01)

(52) U.S. Cl.
CPC ..... *B08B 9/055* (2013.01)

(58) Field of Classification Search
CPC ..... B08B 9/055; A46B 3/06; A46B 5/06; A46B 3/10; A46B 3/04
USPC ..... 15/191.1, 192, 193, 104.061
See application file for complete search history.

(56) References Cited

U.S. PATENT DOCUMENTS

| | | | |
|---|---|---|---|
| 2,449,158 | A | 1/1944 | Benyak |
| 2,472,003 | A | 5/1945 | Cunningham |
| 3,839,763 | A | 10/1974 | Gould |
| 4,016,620 | A | 4/1977 | Powers |
| 4,054,045 | A | 10/1977 | King, Jr. |
| 4,077,079 | A | 3/1978 | Knapp |
| 4,077,080 | A | 3/1978 | Ross |
| 4,083,074 | A | 4/1978 | Curtis |
| 4,393,805 | A | 7/1983 | Boer |
| 4,416,703 | A | 11/1983 | Scott |
| 4,609,228 | A | 9/1986 | Bickel |
| 4,663,795 | A | 5/1987 | Neff |
| 4,716,611 | A | 1/1988 | Barry |
| 4,732,073 | A | 3/1988 | Semon |
| 4,825,498 | A | 5/1989 | Rankin |
| 4,827,553 | A | 5/1989 | Turpin, Sr. et al. |

(Continued)

FOREIGN PATENT DOCUMENTS

| | | |
|---|---|---|
| DE | 3541885 | 6/1987 |
| WO | WO 2006/029008 | 3/2006 |

*Primary Examiner* — Shay Karls
(74) *Attorney, Agent, or Firm* — Bennett Jones LLP

(57) ABSTRACT

A brush useful in pipeline pigs, for example, in magnetic flux leakage tools or cleaning tools, a method of making the brush and pipeline pig comprising the brush. The brush has a metal bristle holder and a plurality of bristles, the ends of which are held in the bristle holder by glue, swaging or a combination of glue and swaging. The glue may be an anaerobic glue. The brush and method of making avoid the use of heat to secure the bristles to the bristle holder, avoid the use of solder or weld metal, and are less labor intensive than soldering or welding.

8 Claims, 8 Drawing Sheets

(56) References Cited

U.S. PATENT DOCUMENTS

| | | | |
|---|---|---|---|
| 4,986,698 | A | 1/1991 | Chin |
| 5,072,622 | A | 12/1991 | Roach et al. |
| 5,113,544 | A | 5/1992 | Webb |
| 5,133,117 | A | 7/1992 | Lomasney |
| 5,265,302 | A | 11/1993 | Sivacoe |
| 5,384,929 | A | 1/1995 | Smith |
| 5,444,886 | A | 8/1995 | Takashina et al. |
| 5,464,275 | A | 11/1995 | Altemare et al. |
| 5,527,213 | A | 6/1996 | Tyler et al. |
| 5,528,790 | A | 6/1996 | Curran |
| 5,600,863 | A | 2/1997 | Curran |
| 5,707,344 | A | 1/1998 | Nakazawa et al. |
| 5,755,003 | A | 5/1998 | Altemare et al. |
| 5,903,945 | A | 5/1999 | Lundie |
| 5,924,158 | A | 7/1999 | Watts |
| 6,014,789 | A | 1/2000 | Knapp |
| 6,065,174 | A | 5/2000 | Laymon |
| 6,070,285 | A | 6/2000 | Geppert |
| 6,171,025 | B1 | 1/2001 | Langner et al. |
| 6,174,381 | B1 | 1/2001 | Ignatiev et al. |
| 6,272,713 | B1 | 8/2001 | Lotwin |
| 6,318,194 | B1 | 11/2001 | Marvin et al. |
| 6,374,838 | B1 | 4/2002 | Baugh |
| 6,438,782 | B1 | 8/2002 | Palmer |
| 6,537,431 | B1 | 3/2003 | Couchman et al. |
| 6,538,431 | B2 | 3/2003 | Couchman et al. |
| 6,569,255 | B2 | 5/2003 | Sivacoe |
| 6,813,949 | B2 | 11/2004 | Masaniello et al. |
| 6,988,777 | B2 | 1/2006 | Pfenniger et al. |
| 2001/0003223 | A1 | 6/2001 | Couchman et al. |
| 2001/0010104 | A1 | 8/2001 | Couchman et al. |
| 2001/0042277 | A1 | 11/2001 | Reichborn |
| 2002/0011124 | A1 | 1/2002 | Phipps |
| 2003/0056309 | A1 | 3/2003 | Savard |
| 2003/0094848 | A1 | 5/2003 | Shia et al. |
| 2003/0110584 | A1 | 6/2003 | Clare et al. |
| 2003/0179651 | A1 | 9/2003 | Nutt et al. |
| 2004/0187244 | A1 | 9/2004 | Giertz |
| 2005/0283930 | A1 | 12/2005 | Hooper et al. |

PIPELINE PIG BRUSH AND BRUSH ASSEMBLY

CROSS REFERENCE TO RELATED APPLICATIONS

The present application is a continuation application of U.S. application Ser. No. 12/946,656 filed Nov. 15, 2010, U.S. application Ser. No. 12/946,656 is a continuation application of U.S. application Ser. No. 11/306,614 filed Jan. 4, 2006. U.S. application Ser. No. 11/306,614 and the present application is a continuation-in-part application of U.S. application Ser. No. 10/710,214 filed Jun. 24, 2004.

FIELD

The present invention relates to the field of brushes and methods of making brushes, particularly metal brushes, for use in pipeline applications.

BACKGROUND

Most pipelines that carry fluids need to be "pigged" at certain times. This is accomplished by inserting a pig into the pipeline at a first point and allowing the fluids flowing through the pipeline to push the pig through the pipeline to a second point where it is caught and removed from the pipeline.

Normally, pipeline pigs fall into two basic categories, non-intelligent pigs and intelligent pigs. Non intelligent pigs are those that perform a maintenance or operational function, e.g. cleaning, —such as scraping of solids from the interior of the pipe; swabbing—such as removing liquids or gases from the pipeline; batching—such as separating different fluids in the pipeline, etc. Intelligent pigs are those that monitor and convey information about a particular condition or performance of the pipeline.

Brushes, particularly metal brushes, may be used in various pipeline applications.

For example, Magnetic Flux Leakage (MFL) is an in-line inspection method used to evaluate and monitor metal loss in pipelines, which can result for example from corrosion of pipelines. Metal brushes are used in MFL tools as part of a magnetizing system that is used to magnetize the pipe that is being inspected. The ends of the metal brushes rub against the wall of the pipe and transmit the magnetic field to the measuring instrument. The data around a defective section in a pipeline is then interpreted to provide a quantitative analysis on the amount of damage.

As another example, brushes, including metal brushes, may be used as cleaning brushes in pipeline cleaning applications. Cleaning pigs, which are known in the art, are used in a number of different applications, for example for regular maintenance of pipelines or to remove heavy deposit and buildup, as by scraping.

Metal brushes have previously been produced by bonding steel bristles to a ferrule or other support by use of solder. However, the use of solder to bond the bristles to each other and to the ferrule or other support presents problems, and is not ideal. As it is not ferrous, it is somewhat insulating and therefore is less conductive than desired for some applications. The process of soldering uses flux, which causes corrosion and which also can affect the magnetic properties of the brush. Solder is a malleable material and has inferior retention properties, causing the bristles to tend to become detached from the solder, and therefore the brush. To effectively solder bristles into a ferrule or other support, heat is used, and depending upon the amount and duration of heat, the physical properties of the bristles can be altered (e.g., tensile strength). Finally, to effectively solder bristles into a ferrule or other support, the bristles usually have to be treated or coated with a material such as tin or nickel, which smoothes the surface of the bristles and allows the molten solder to wick up the support and between the bristles.

In order to avoid some of the problems associated with the use of solder, the inventors have used welding instead of soldering to hold a bristle bundle into a ferrule or other support. While welding has some definite advantages over soldering, welding is expensive in terms of capital and/or labor costs, it is labor intensive (as is soldering), it requires the use of heat and therefore in some instances will negatively affect the properties of the bristles (hardness, brittleness), and the weld metal differs in conductivity from the bristles, which may be problematic in some applications.

What is needed is a less labor-intensive process than soldering or welding that can be used to securely hold a bristle bundle in a metal support, for use in pipeline applications. Preferably, this process would avoid the use of heat, and would be less costly while providing as good as or better retention, than soldering or welding.

SUMMARY

The present invention provides a new method of manufacturing a brush useful in pipeline pigs, a brush produced thereby and pipeline pigs comprising the brush. The method uses glue or swaging, alone or in combination, to secure the ends of the bristles of the brush, into a bristle holder.

The use of glue and/or swaging avoids one or more of the problems associated with prior art pipeline pig brushes made by soldering or welding. The use of glue and/or swaging to secure the bristles avoids the use of applied heat and yet provides brushes of suitable bristle retention for use in MFL tools, which retention may be superior to that obtained with soldering and/or welding. It was unexpected that a non-heating method of attachment, such as glue or swaging, or a combination thereof, would provide adequate bristle retention in the harsh environment in which a pipeline pig is used. Further, it was expected that welding and/or soldering would be required to provide adequate retention of the bristles in the brush, for the pipeline applications contemplated herein.

The brush of the present invention when compared to a soldered brush, may be more resistant to corrosion, may also be more electrically conductive and may also be better at transmitting a magnetic field. As compared to a brush made by welding, the brush of the present invention may be less costly to make, in terms of labor and capital costs, may be more electrically conductive and may be better at transmitting a magnetic field. When used in an MFL tool, the present brush may have the particular advantage that the end of each bristle may be in direct contact with the base of the MFL tool.

Therefore, in one aspect this invention is a pipeline pig brush comprising:

(a) a metal bristle holder that defines at least one retention cavity, and (b) a bristle bundle within the retention cavity secured to the bristle holder with either: (i) glue, (ii) swaging, or (iii) glue and swaging.

In one embodiment, the bristle holder may be a tube that comprises one retention cavity. In this embodiment the bristle holder may be secured to the tube with swaging, or with glue and swaging. In another embodiment, the bristle holder may be a metal structure that comprises more than one retention cavity, and the bristle bundle may be secured to the metal structure with glue.

In another aspect the invention is a pipeline pig comprising the above brush. The pipeline pig may be a magnetic flux leakage tool.

In another aspect, the invention is a method of making a pipeline pig brush comprising:

(a) providing at least one bundle of bristles, (b) inserting the bundle of bristles into a retention cavity of a bristle holder, and (c) securing the bundle of bristles to the bristle holder by either: (a) glue, (b) swaging or (c) a combination of glue and swaging.

In one embodiment of the method the bristle holder may be a tube that comprises one retention cavity. In another embodiment the bristle holder may be a metal structure comprising more than one retention cavity, and the bundle of metal bristles within each retention cavity may be secured to the metal structure with glue.

In another aspect the invention is a pipeline pig brush assembly comprising at least one brush, as defined above, secured to a larger metal object with an interference fit, a transition fit or a clearance fit, between the metal bristle holder and a hole of the larger metal object, and optionally, with glue. In another aspect the invention is a pipeline pig brush assembly comprising at least one brush, as defined above secured with glue into a hole of a larger metal structure. The larger metal object may be a metal plate.

In yet another aspect, the invention is a magnetic flux leakage tool comprising the brush assembly as described above.

In another aspect the invention is a method of making a pipeline pig brush assembly comprising:

(a) providing at least one brush as defined above, said brush comprising a bound surface and a brush surface, (b) providing a larger metal object that has a top surface and a bottom surface and at least one hole, (c) securing the at least one brush in the at least one hole using either: (a) an interference fit or a transition fit between the bristle holder and the hole, (b) glue, or (c) both glue and an interference fit, a transition fit or a clearance fit, such that the brush surface extends from the top surface of the larger metal object.

In one embodiment of this method, after the brush is secured in the hole, the bound surface of the bristle bundle may extend past the bottom surface of the larger metal object. The method may further comprise the step of forming a contact surface that is flush with the first surface of the larger metal structure. This may be done, for example, by grinding, machining, milling or sanding the bound surface so that it is flush with the bottom surface.

In another embodiment, this invention is a magnetic flux leakage tool that comprises a brush assembly made by the methods described above.

The hole may comprise a positioning element, such as a shoulder, to assist in proper positioning the brush in the hole. A fixture that applies force to the bristle holder may be used to insert the brush into the hole.

In another aspect the invention is a pipeline pig brush comprising a tubular metal bristle holder and a plurality of bristles each with a first end and a second end, wherein the first ends of the metal bristles are secured to the bristle holder by swaging and optionally glue. In another aspect, the invention is a pipeline pig comprising said brush. In yet another aspect, this invention is a brush assembly for use in a pipeline pig, comprising a metal plate having at least one hole, and said brush secured in the hole by an interference fit or a transition fit between the bristle holder and the hole, glue, or an interference fit, a transition fit or a clearance fit and glue. In yet another aspect, this invention is a pipeline pig comprising said brush assembly.

BRIEF DESCRIPTION OF THE DRAWINGS

In FIG. 1A the bristle holder is a tube, which is shown in longitudinal section. In FIGS. 1B and 1C the bristle holder is a plate, the contact surface is flat in FIG. 1B and curved in FIG. 1C and the brush surface is contoured differently in FIGS. 1A to 1C.

DETAILED DESCRIPTION OF PREFERRED EMBODIMENTS

Figure 1C:
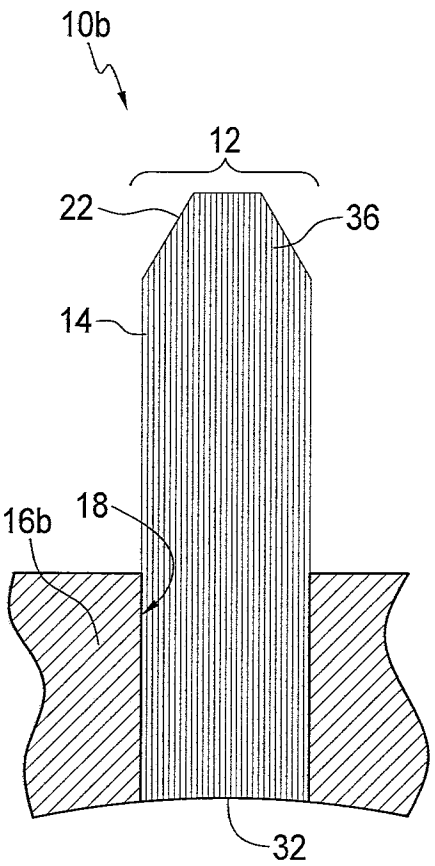
FIGS. 1A, 1B and 1C are partial cross-sectional views of embodiments of a metal brush.

Reference will now be made to the Figures, which show various embodiments of the brush. The brush 10 comprises at least one bundle 12 of bristles 14, the ends of which are secured to each other and also to a bristle holder 16. The bristles may be secured to each other and to the bristle holder by swaging 17, by using glue 19, or by using a combination of swaging and glue.

As is understood in the art, the term "pipeline pig" or "pig" is used to describe any structure or device that freely moves through a pipeline to carry out a particular function, such as cleaning, dimensioning or inspecting.

"Metal", as used herein, includes alloys.

Bristles 14 may be metal filaments, fibers, wires or other such elongate structure. Any of a number of different types of metals may be used, depending upon the application. For example, in one embodiment the metal may be steel, for example carbon steel. In another embodiment, the bristles may be coated wires. In brushes used for MFL tools, magnetically transmissive metals may be used. In brushes used for cleaning tools, transmissivity or conductivity of the bristle may not be as important as the strength or durability of the bristle. The bristles may also be non-metal, for example, plastic monofilaments, natural type fibres and synthetic fibres such as nylon fibres impregnated with silicon carbide. The latter may be used in a pipeline pig for cleaning. A brush 10 may be made of more than one type of bristle 14.

Figure 3C:
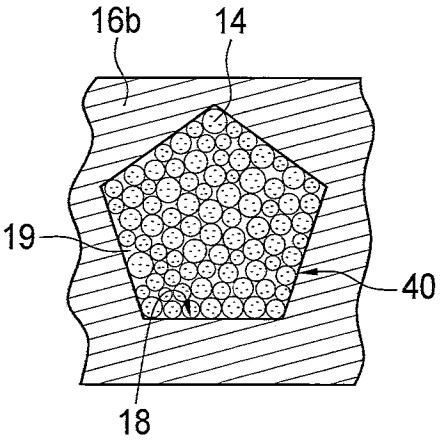
FIGS. 3A, 3B and 3C are partial cross sectional views along line I-I of FIG. 2A (A and B) or along line II-II of FIG. 1B, showing a bristle bundle with different cross-sectional shapes secured in the bristle holder.
Figure 3B:
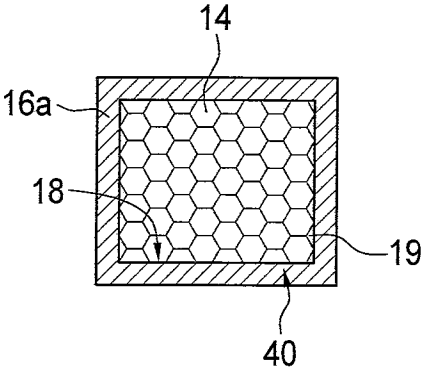
Figure 3A:
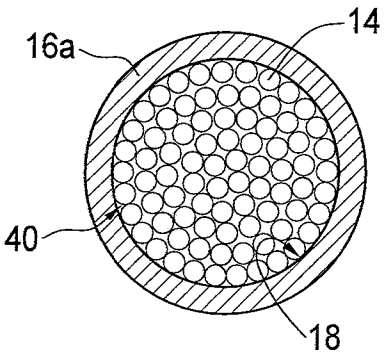

The cross-sectional shape and size of bristles 14 useful in brush 10 may be selected to maximize the contact of the bristles with one another, and to minimize the air space between the bristles. A number of different cross-sectional shapes and sizes of bristles 14 may achieve this result. As non-limiting examples, the bristles may be circular, oval, polygonal (non-limiting examples are triagonal, tetragonal, hexagonal) or irregular in cross section. The bristles may be packed tightly within the bristle holder, resulting in no, or negligible, air space between the bristles. The packing of bristles 14 having a circular shape or hexagonal shape in cross section is shown in FIGS. 3A and 3B. As is apparent, all bristles in a bristle bundle need not have the same or similar cross-sectional shape or size, as shown in FIG. 3C, in order to achieve a closely spaced relation within the bristle holder.

Bristle holder 16 may be a metal construct that comprises at least one retention cavity 20, such as an opening or bore, for insertion of bristle bundle 12 therein. Retention cavity 20 may be accessible from both ends, or it may be closed or partially closed at one end.

In one embodiment, bristle holder 16 may be a metal tube, ferrule, sleeve, bushing, or similar construct as shown in FIGS. 1A, 2, 5 and 6. All such structures are referred to herein as a tube. The metal tube forms a retention cavity 20 that includes a metal inner surface 18, to which bristles 14 may be secured. Some embodiments of these types of brushes are known in the art as pencil brushes.

Figure 8A:
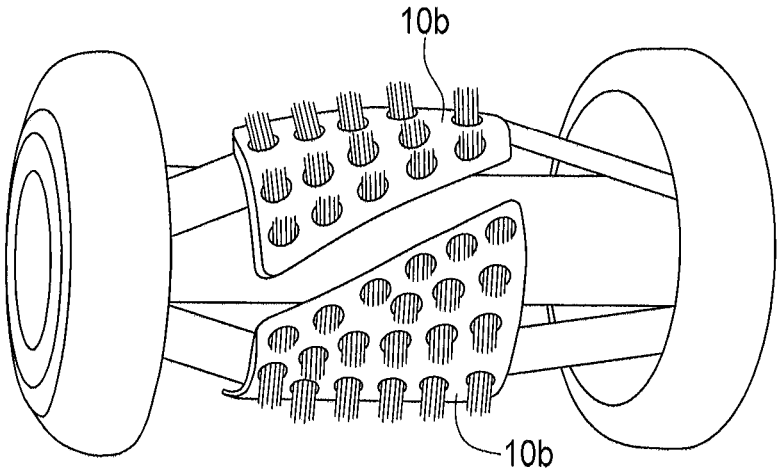
FIG. 8A is a cleaning pig comprising brushes of the type shown in FIG. 1B, 1C or 4B
Figure 8B:
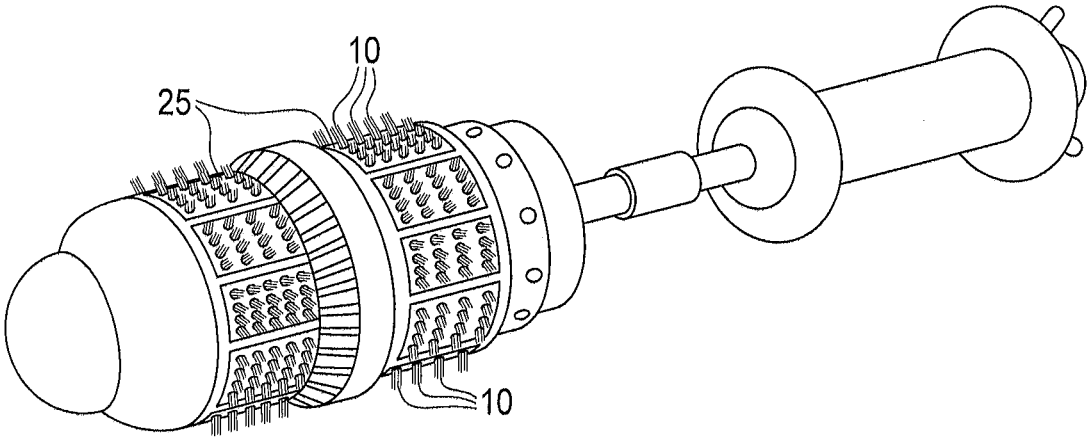
FIG. 8B is a magnetic flux leakage tool comprising brush assemblies of the type shown in FIGS. 4A, 5 and 6, which assemblies comprise at least one brush 10.

This embodiment of brush 10 may be used to form a brush assembly 25, for example, by securing one or more brushes 10 to a larger metal object 15 (see FIG. 5 or 6), for example a plate, tube, bar, pipeline pig that may be used as an MFL tool or as a cleaning tool. As non-limiting examples, the larger object 15 may be a metal plate, such as a rectangular metal plate, that comprises a series of holes 21 bored in linear or circular arrays. Within at least some holes may be secured a brush 10. An example of this is shown in Figure shown in FIGS. 4A, 5 and 6. The brush 10 may be secured in the holes by an interference fit (e.g., press fit or shrink fit), transition fit or clearance fit. After one or more brushes 10 are secured into the holes of the larger object a mounting plate or magnet may be screwed onto the object, in contact with contact surface 32 of the brush 10. This type of brush assembly is particularly useful in a MFL tool, an example of which is shown in FIG. 8B.

Figure 6:
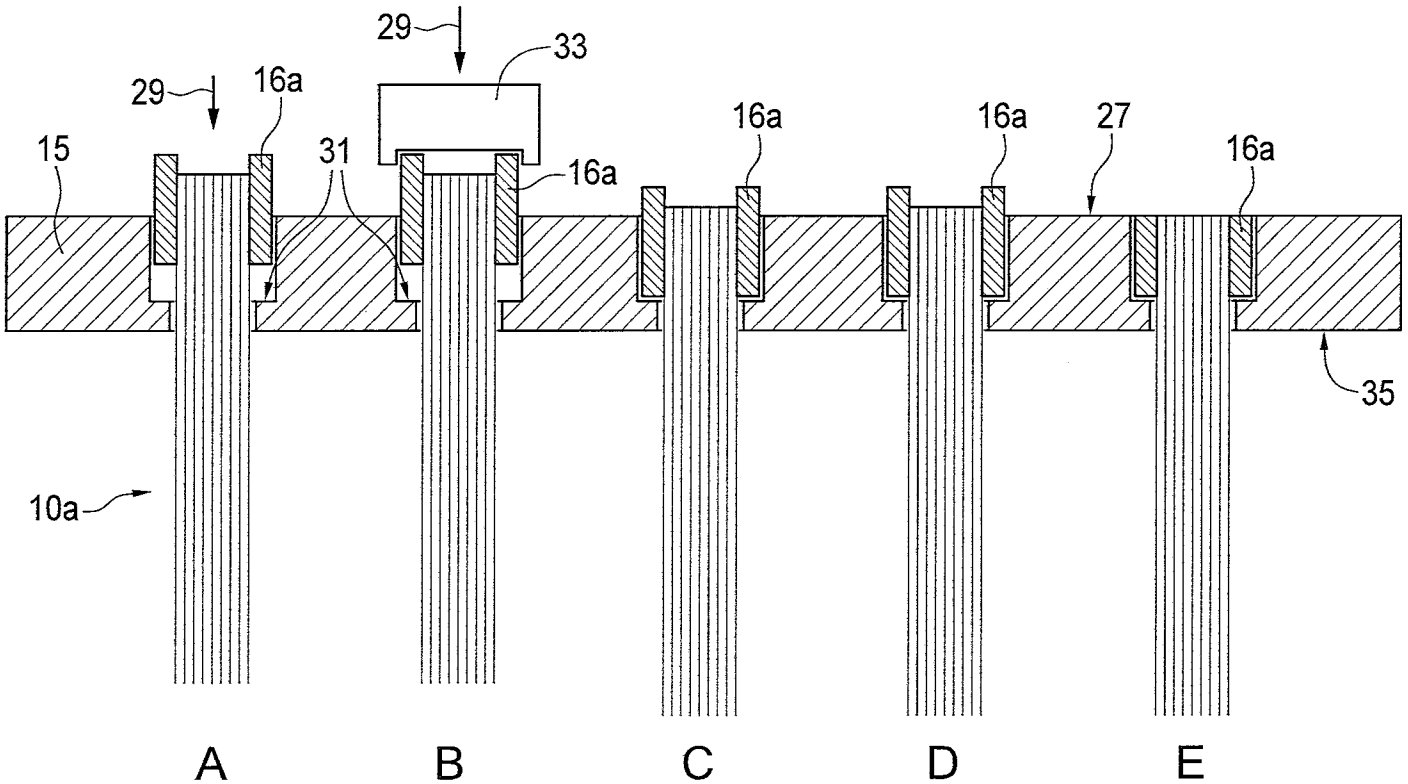
FIG. 6 is a cross sectional view along line III-III of FIG. 5, and shows how a brush may be secured by a press fit, into a plate, and then surface ground to provide a flat contact surface.

To assist in the positioning of brush 10 into the holes, the holes may comprise a positioning element 31, such as a shoulder or an angled edge, to prevent the further progression of the brush 10 through the hole as the brush is forced in the direction of arrow 29 (FIG. 6). In one embodiment, the position of the shoulder in the hole results in protrusion of the ends of the bristles 14 and/or the end of the bristle holder 16, above surface 27 of larger device 15. Alternatively, brush 10 may be secured into a hole 21 that is through hole (i.e., no positioning element in the hole itself) and secured, for example by glue alone, or by glue and an interference fit.

Figure 4B:
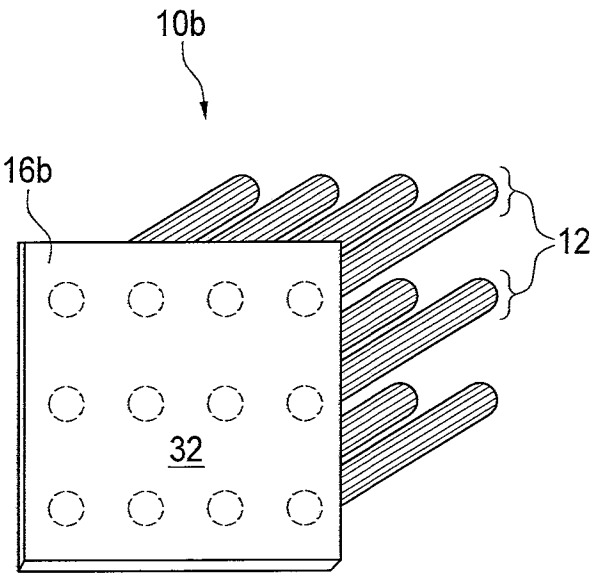
FIG. 4A is a side view of a plurality of brushes secured to a metal plate to make a brush assembly, and 4B is a perspective view of a plurality of bristle bundles secured to a metal plate to make an embodiment of the brush.

In another embodiment, bristle holder 16 may be a larger metal structure 16*b* comprising at least one retention cavity 20, as shown in FIG. 1B, 1C, 3C or 4B. In this embodiment, bristle holder 16 may be, for example, a metal plate, tube, bar or pipeline pig into or through which one or more retention cavities 20 may be bored. The plate, tube, bar pig or other such entity may form one or more retention cavities 20, of the same or different shapes, each of which may be capable of accepting a bristle bundle 12. As non-limiting examples, a pipeline pig may comprise a series of retention cavities 20 bored around its perimeter, in a series of circles, in a helical arrangement, or in an irregular/random arrangement, and within at least some cavities may be secured a bristle bundle. Accordingly, in this embodiment bristle holder 16 may hold more than one bristle bundle, an example of which is shown in FIG. 4B. After one or more bundles of bristles are secured to the retention cavities 20 of the larger device, a mounting plate or magnet may be screwed onto the device, in contact with contact surface 32 of the bristle bundles.

As is apparent, bristle holder 16, regardless of whether it is a tube or a larger structure, may have a retention cavity that is any of a number of shapes in cross section, including but not limited to, circular, oval, polygonal (for example, triangular, tetragonal, hexagonal), crenate, scalloped, and irregular.

The retention cavity 20 may have sides that are parallel to one another, as in a cylinder. Retention cavities such as these are as shown in the Figures. Alternatively, retention cavity 20 may have sides or a portion thereof that are not parallel to one another, but rather are curved, flared, cone-shaped or irregular in shape.

Bristle holder 16 may be made of metal, which in one embodiment may be steel. If used in an MFL tool magnetic transmissivity is important, and the steel may be carbon steel, for example. If used in a cleaning pig, transmissivity and conductivity may be less important, and the steel may be stainless steel, for example. Any of a number of different types of metals may be used, depending upon the application. For example, if electrical conductivity is important, copper may be used.

The bristles 14 of bundle 12 may be packed in a closely spaced relation within bristle holder 16, meaning that the bristles may be packed so as to minimize the amount of air space between the bristles and to maximize the amount of contact of the bristles to each other and to surface 18 of retention cavity 20. Packing of the bristles 14 in a closely spaced relation within bristle holder 16 may be important for brushes used in MFL tools, as decreasing the air space increases the transmissivity. Close packing may also be important for maximizing the durability and lifespan of brush 10. If the bristles are packed in a closely spaced relation, they may be less likely to become detached from the bristle holder during use of the brush.

Bristles 14 may be secured to each other and to bristle holder 16 by using glue, swaging, or a combination of glue and swaging. As is apparent, swaging cannot be used in the circumstance where bristle holder 16 is a larger structure 16*b* comprising at least one retention cavity 20, as shown in FIG. 4B and discussed above.

In one embodiment, bristles 14 are glued to each other and to bristle holder 16. As the environment of the bristles 14 in the bristle holder 16 lacks significant air or oxygen, anaerobic glues are preferred glues for use in securing the bristles, as these glues are able to cure in the absence of air or oxygen. However, it is possible that other glues of sufficient strength, even if not anaerobic, may be used. An important characteristic of the glue is its viscosity, as viscosity will affect the capillary action of the glue and therefore its ability to wick up into and between the bristles, and thereby to coat all of the bristles in the bundle. Examples of useful anaerobic glues, are anaerobic glues from Loctite®, such as Loctite 603 Retaining Compound. One useful glue has a viscosity @ 25° C., mPa·s (cP), Brookfield RVT, Spindle #1, 20 rpm, of 100 to $150^{LMS}$, however glues with other viscosities may be used as well. Bristles 14 may be cleaned to remove oil and debris, before gluing the bristles into the bristle holder 16. This can be accomplished by soaking the bristles in a cleaner such as acetone and/or degreasers, by standing the bristle bundle vertically in a bath of cleaning solution.

A primer may also be applied to the bristles 14, before the glue is added. The primer may be used when gluing inactive metals, for example, plated metal, titanium, stainless steel, galvanized steel, zinc, pure aluminum, gold, silver, cadmium, magnesium, or active metals such as iron, plain steel, copper, brass, bronze and nickel. The primer strengthens the bonding of the glue to both active and inactive metals, for example by creating a rough etched surface, which allows the glue to form a stronger bond with the surface.

Figure 5:
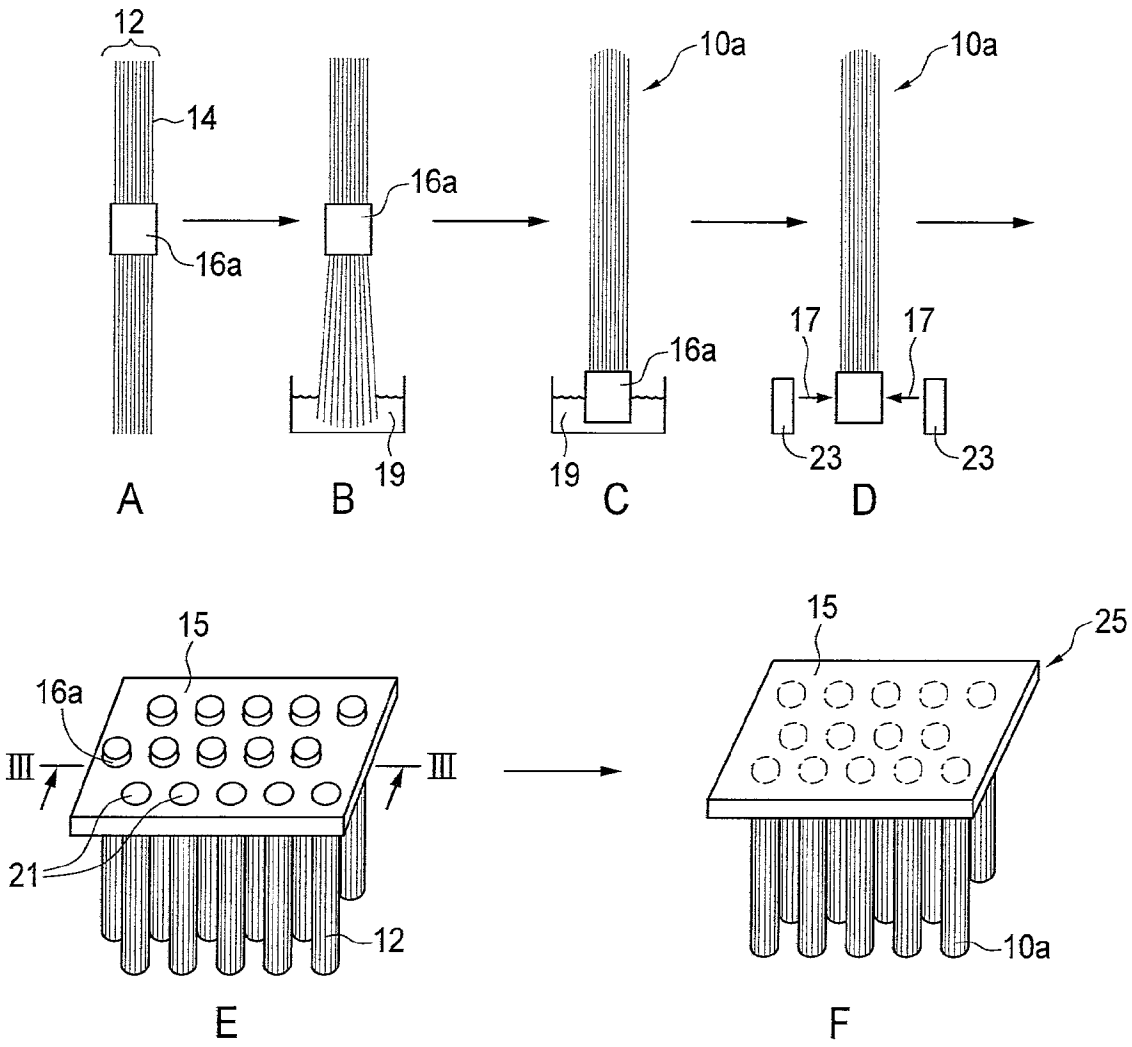
FIG. 5 is an embodiment of the various steps in the method of making a brush and brush assembly.

In addition to using glue, or instead of using glue, bristles 14 may be held in bristle holder 16 by the use of swaging. Swaging is a process that is used to reduce the diameter of tubes and/or rods by hammering radially to applying compressive force to the tube and/or rod. Swaging presses, such as hand, bench and hydraulic swaggers are well known by those of skill in the art. Generally, a swaging press comprises an annular ring that includes an internal wedge surface. A series of circularly arranged swaging dies have external conical wedge surfaces that mate with the internal wedge surface, and they form an internal chamber and support to hold the tube and/or rod. As the annular ring moves axially, the swaging dies close radially around the tube and/or rod. The radial compressive forces cause the tube to deform around the bristle bundle. Arrows 17 in FIG. 5 represent the force applied by a swaging press 23.

Hand, bench or hydraulic swaggers may be used to make the brush disclosed herein. In one embodiment, the swaging press is of a type used for wire, rope and cable assemblies, such as the Promec Q6000™ Wire and Rope Swager. This machine provides up to 175 tones of swage press power. The Promec swager comprises 2 half circle type dies. For some applications, the bristle holder with the bristles therein is swaged multiple times, to obtain a bristle holder that is as round as possible and to apply maximum compression. The process of multiple compressions is typically used in the wire rope industry. The sleeve may also be compressed with a multiple dies swaging machine that compresses the bristle holder only once. This swaging process is used in the hose and fitting industry and may hold a circular dimension better than a process that uses multiple compressions. Examples of multiple dies swaging machines are those made by Hydrapower Dynamics Limited.

Generally, swaging alone or gluing alone may be used with smaller diameter bristles and as the bristle diameter increases, a combination of swaging and gluing may be preferred. However, whether swaging, gluing or a combination of both is used, will depend upon a number of factors, including the pull strength required and the length of the brush trim. Without being limited to a theory, it appears that with the smaller bristle diameters, because there is less air space between the bristles, either gluing or swaging may be used. As the diameter of the bristles increases and there is a concomitant increase in the air space between the bristles, both gluing and swaging appear to provide better and more consistent results in terms of bristle retention.

The inventors have found that, generally, gluing and swaging provides greater retention (as measured by pull strength) of the bristles than does soldering alone, and that the addition of primer to the glue provides for even better retention. Swaging also provides the added benefit, particularly for brushes that are to be used in MFL tools, of compressing and aligning the bristles, squeezing out excess air between the bristles, and forcing the bristles into close contact with one another. As compared to welding, the use of glue and/or swaging may also be beneficial because there is no weld metal present in the brush itself to interfere with transmission of the magnetic field. The bristles alone transmit the magnetic field. Further, in some embodiments the metal brush may be ground to various profiles at contact surface 32, which grinding may be easier to do if there is no weld metal present.

The bundle 12 of bristles has a brush surface 22 and a bound surface 24. At brush surface 22 of the bundle, the individual bristles 14 may not be attached to one another. At bound surface 24 the bristles may be in a closely spaced relation to one another, and they may be secured in the bristle holder by gluing, swaging, or both. After the bristle bundle is secured in the bristle holder, the ends of the bundle may be ground down to form a smooth contact surface 32.

Bound surface 24 of the bundle 12 may extend part way through and up to completely through, retention cavity 20. In one embodiment, shown in FIG. 2A, bound surface 24 of bundle 12 may be positioned part way through retention cavity 20, thus leaving a space 26 at one end of the retention cavity. The size of space 26 may be increased or decreased, depending on the application. In another embodiment, shown in FIG. 2B, bristles 14 may extend all the way through retention cavity 20 past end 30 of bristle holder 16, and therefore bound surface 24 extends beyond end 30. In yet another embodiment, bristles 14 may extend all the way through retention cavity 20 to end 30 of bristle holder 16, and therefore bound surface 24 extends to end 30. In these latter embodiments, no space 26 is left at the end of retention cavity 20.

Figure 1B:
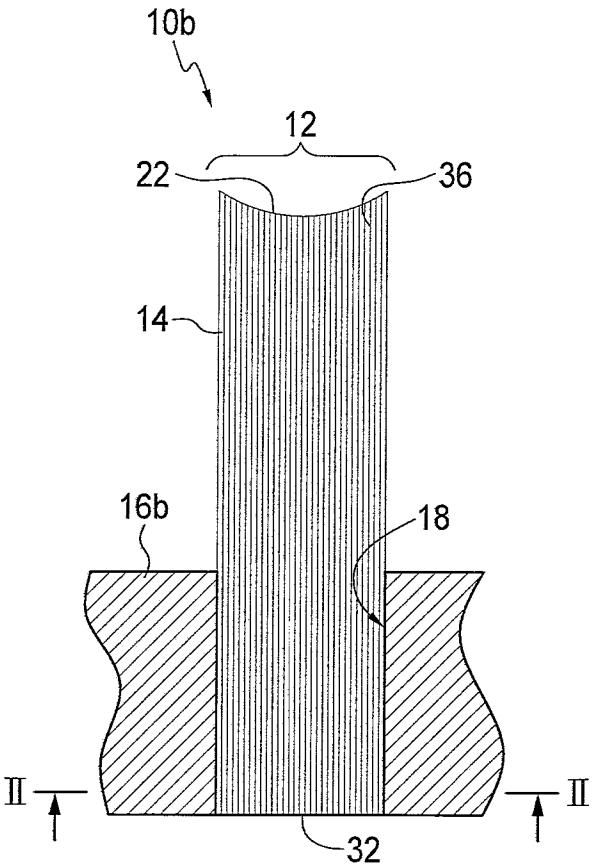
Figure 1A:
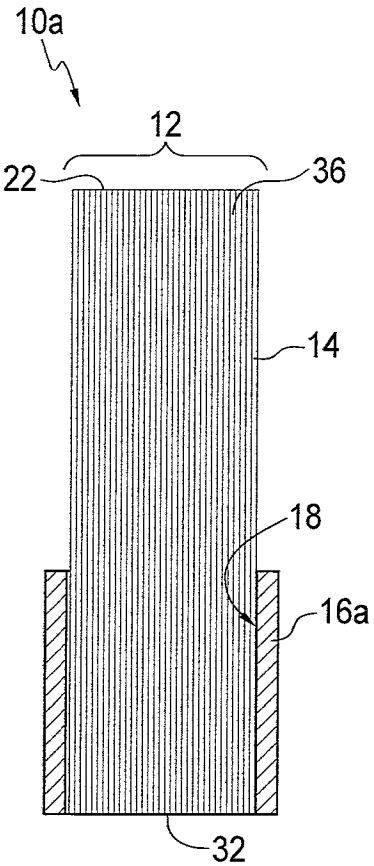
Figure 2C:
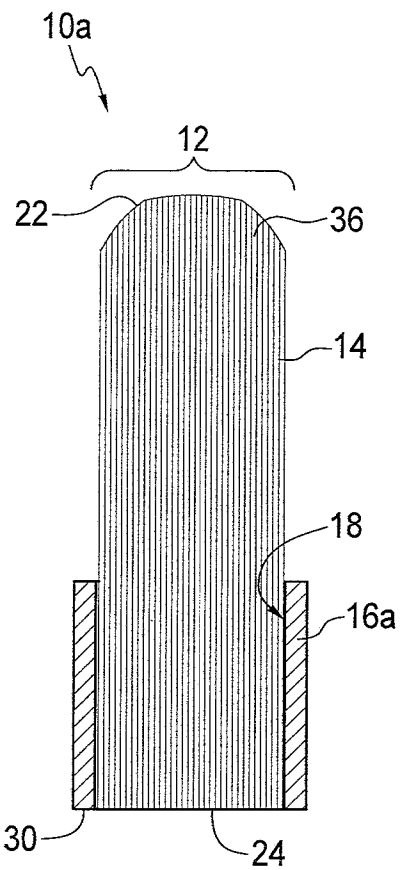
FIGS. 2A, 2B and 2C are partial cross sectional views showing embodiments of a metal brush.
Figure 2B:
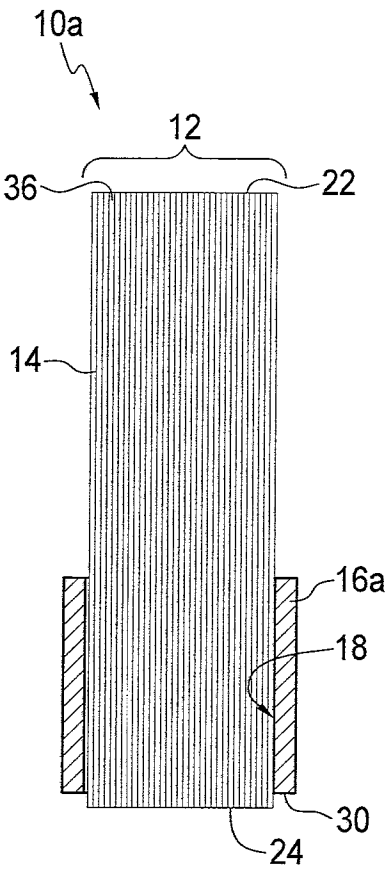
Figure 2A:
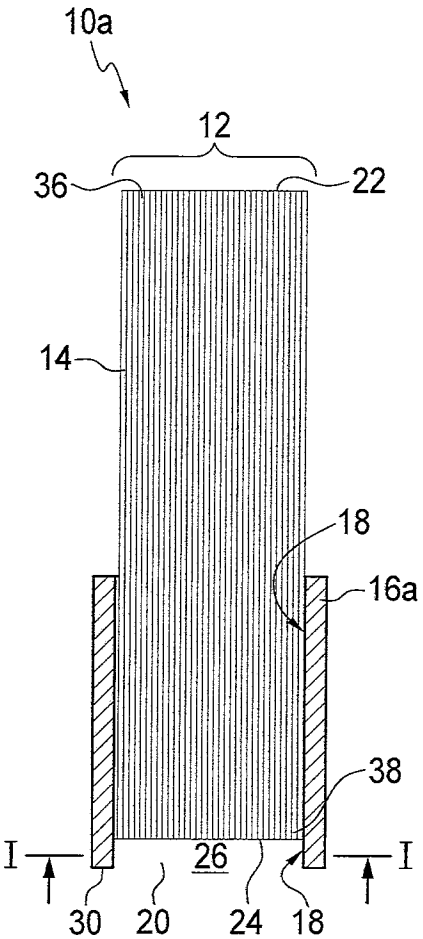

The brush surface 22 and bound surface 24 of the bristle bundle may have a flat profile, as shown in FIGS. 1A, 2A and 2B, or a contoured profile as shown in FIGS. 1B, 1C and 2C. It is understood that the bristle bundle can have any one of a number of contoured profiles at either end, including, for example a peak, a valley (i.e., inverted V), grooves or an irregular/random profile. As is apparent, brush surface 22 and bound surface 24 may have different profiles.

Figure 4A:
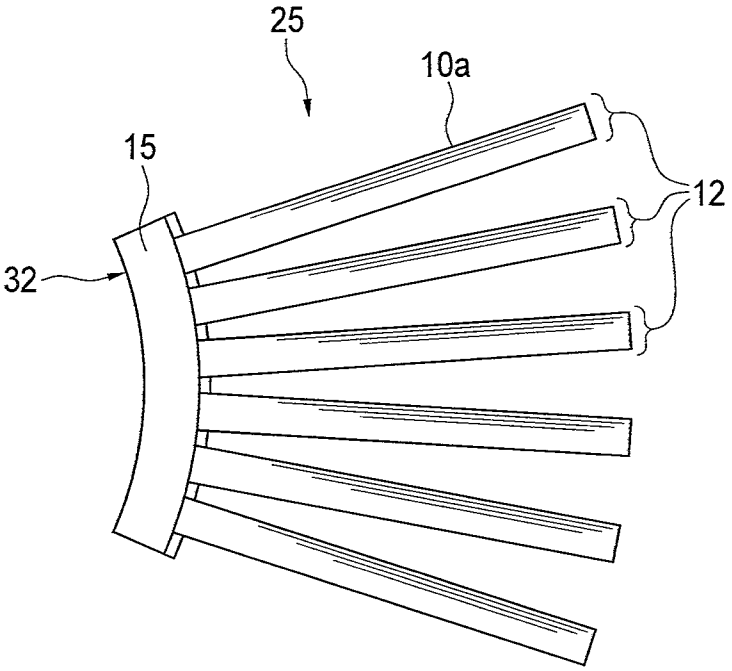

Contact surface 32 of brush 10 may be formed by further processing of bound surface 24, as by surface grinding. In some embodiments of brush 10, bound surface is not further processed and therefore bound surface 24 and contact surface 32 are the same (e.g., in some cleaning brushes). Surface 32 may have any of a number of different profiles. In the embodiment shown in FIGS. 1A, 1B, 2C and 4B, contact surface 32 has a flat profile, which may be contiguous with end 30 of bristle holder 16. A brush with a flat profile at contact surface 32 may be particularly useful in an MFL tool, as a flat surface will maximize transmissivity. However, as is apparent, contact surface 32 alone, or in conjunction with end 30, may have one of a number of other profiles, such as for example, a convex, concave, peaked, grooved or even irregular profile, as shown in FIGS. 1C and 4A (which embodiment may be particularly useful in an MFL tool). A brush may have more than one contact surface-see FIG. 4B, where the brush 10 comprises a plurality of bundles 12, each with a contact surface 32.

Method of Making a Brush

Brush 10 may be made by assembling the bundle 12 of bristles 14 within bristle holder 16, and then securing the bristle bundle to the bristle holder by either gluing, swaging, or gluing and swaging. This process is shown in FIG. 5.

An automatic wire cutter may be used to cut, count and assemble an exact number of bristles 14, per bundle 12. Spools or coils of wire are fed continuously into the automatic wire cutter, where they are straightened, cut to a predetermined length, and assembled into bundles. In one embodiment, the bristles in a bristle bundle are within a tolerance limit of +/−0.015 inches. Alternatively, precut bristles may be purchased and assembled into bundles by weighing or counting the bristles.

Bristles 14, which have a first end 38 and a second end 36, are assembled in parallel arrangement into a bundle and one end of the bristle bundle may then be inserted into a bristle holder 16, such as a tube, as shown in drawing A of FIG. 5. This process may be assisted by using a filling device that has straight or sloped sides, or by using a tube holder fixture that has a detachable/locking mechanism, to hold the bristle holder 16 while it is being filled with bristles.

If the ends of the bristles 14 are then to be glued together, one end of the bundle 12 of bristles may then be dipped into a glue bath, with the ends of the bristles 14 held in a somewhat spread apart relation, as shown in drawing B of FIG. 5. In one embodiment the glue bath has a depth of 0.750 inches. The end of the bundle may be left in the glue to allow time for the glue to wick up between the bristles—for example for 5 minutes. If the bristle holder 16 is a tube, it may then be slid down over the end of the bundle, as shown in drawing C of FIG. 5, thus squeezing excess glue back into the glue bath. A toggle activated sliding jig may be used to move the bristle holder 16 to a position that is a specific distance from the end of the bristles 14, after which time the brush may be left for a period of time sufficient to permit the glue to cure.

If the bristle holder is a plate 16*b* comprising a plurality of retention cavities 20, then a bristle bundle 12 may be secured in the retention cavities by using glue. The plate may be submerged in glue in a tray and one end of a bundle 12 of bristles can be inserted in a cavity 20. Alternatively, the plate may be elevated, and a bristle bundle 12 can be inserted in a cavity 20 so that the bundle extends downward from the cavity. The desired amount of glue may then be released into or on top of the bristle bundle, whereafter it may wick downwards into the bundle.

Swaging, as represented in drawing D of FIG. 5 may be used to secure the bristles 14 in the bristle holder 16, and may be used in addition to the gluing step, or without the gluing step. In some applications gluing may be adequate in order make a brush suitable for a desired objective. Therefore, in some embodiments of the methods of this invention, only the gluing steps outlined in FIG. 5 (parts B and C) are used to secure the bristles to the bristle holder. In some applications swaging alone may be adequate in order make a brush suitable for a desired objective. Therefore, in some embodiments of the methods of this invention, the gluing steps outlined in FIG. 5 (parts B and C) are not performed in order to secure the bristles to the bristle holder. In other applications both gluing and swaging may be preferred.

For swaging, bristle holder 16*a* may be loaded into a swaging press 23, as shown in FIG. 5D. The swaging press comprises a die, into which the bristle holder 16*a* may be positioned. The press then applies compressive force by hammering radially on the bristle holder, to deform it inwards and thereby to securely hold the bristle bundle therein. The force applied to bristle holder 16 by the swaging press 23 is represented by arrows 17 in FIG. 5. The swaging processes used herein are described in more detail above.

The ultimate shape of the bristle holder 16 may be determined by the shape of the die in the swaging press. For example, the die may be circular, oval, hexagonal, or any of a number of other shapes.

Figure 7A:
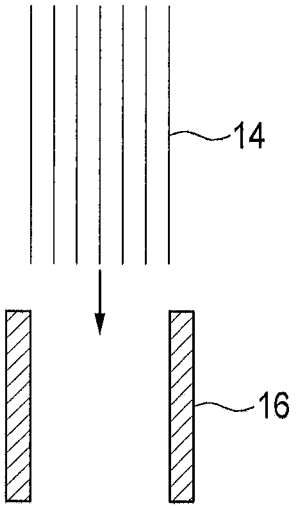
FIGS. 7A, 7B and 7C show an alternative embodiment of the method of making the brush.
Figure 7B:
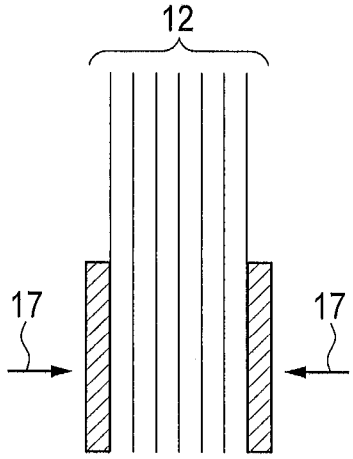
Figure 7C:
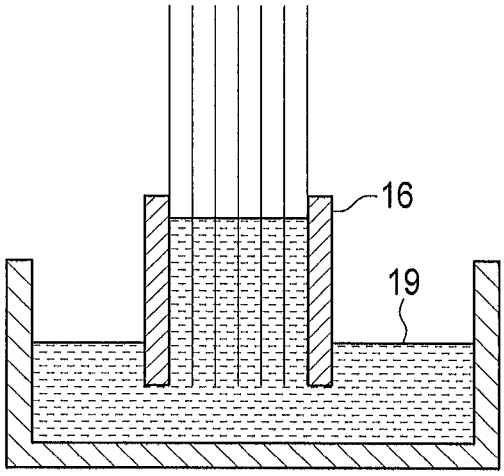

In an alternative embodiment of the method, shown in FIG. 7, bristle bundle 12 is first secured into bristle holder 16 by swaging (FIG. 7B), and the end of the brush is then dipped into glue (FIG. 7C) to permit the glue to wick upwards between the bristles. This method may be preferred in some applications, as the swaging is used to orient and arrange the bristles to have them properly nested together to avoid larger air gaps. The smaller spaces between the bristles seem to provide more effective retention by the added glue.

Bristle holder 16 may be positioned so that it extends beyond surface 24 of the bundle 12 of bristles 14, leaving space 26 between end 30 of bristle holder 16 and surface 24 of the bristle bundle, as shown in FIG. 2A. In one embodiment, there is about a 1 mm gap between the two respective ends. Alternately, bristle holder 16 may be positioned so that end 30 of the bristle holder is flush with surface 24 of the bundle 12 of bristles, as shown in FIG. 2C. Alternately again, bristle holder 16 may be positioned so that surface 24 of the bristle bundle extends beyond end 30 of bristle holder 16, as shown in FIG. 2B.

After bristles 14 are secured within bristle holder 16, by gluing, swaging, or both, contact surface 32 of brush 10 may be formed by surface grinding or machining to a desired shape.

Once bundle 12 of bristles 14 is secured within bristle holder 16, the resultant brush 10 may be inserted into a larger metal object 15 to form a brush assembly 25. This may be done, for example, if bristle holder 16 is a tube, the shape of which is complementary to a hole 21, in the larger metal object. In a preferred embodiment, the larger object 15 is a metal plate-like structure, with a bottom surface 27 and a top surface 35, and may comprise a number of holes 21, into each of which may be inserted a brush 10.

Brushes 10 may be secured into the larger metal object 15 by using glue, and/or an interference fit (e.g., a press fit, shrink fit or expansion fit), a transition fit or a clearance fit. In one embodiment, hole 21 is machined to a slightly smaller diameter than bristle holder 16*a* of brush 10. For example, bristle holder 16*a* may be about 0.001-0.002" larger in diameter than hole 21. The two parts are then forced together slowly using a press, or other force-applying means (e.g., the impact of a hammer), to create normal and frictional forces between the parts. Alternately, a shrink fit may be used, in which the plate is heated to temporarily expand its inside diameter and/or an expansion fit can be made by cooling the bristle holder 16 to temporarily reduce its outside diameter. The heated and cooled parts are then slipped together and when the assembly returns to room temperature the dimensional changes in the parts create the required interference for frictional contact. Alternately again, a clearance fit using glue, may be used to secure a brush into the larger metal object.

The insertion of brush 10 into object 15 using a press fit is accomplished preferably by applying force (see arrow 29 in FIG. 6) to the end of bristle holder 16, and not to the ends of the bristles. This may be accomplished by positioning end 30 of bristle holder 16 past the surface 24 of the bristle bundle 14, leaving space 26. The force is then applied directly to the bristle holder. Alternately, a fixture 33 may be designed to fit on top of bristle holder 16, to contact the end of bristle holder 16, and not the bristle bundle.

Where the larger object 15 is a metal plate-like structure with a bottom surface 27 and a top surface 35, brush 10 may be inserted into hole 21 of the plate sufficiently far so that bound surface 24 of bundle 12 and perhaps also the end 30 of bristle holder 16 protrude beyond bottom surface 27 of the plate. In one embodiment, at least about 1 mm of the ends of the bristles 14 in the bundle 12 protrudes beyond surface 27 of the plate. A shoulder 31 may be included inside hole 21 to stop the advancement of bristle holder 16 and to thereby ensure that the brush is not inserted further into the hole than desired.

The assembly 25 may then be machined, as by surface grinding, to a flat surface so that the ends of bristles 14, and perhaps also the end of bristle holder 16, are flush with surface 27 of the plate 15. Or, in other words, contact surface 32 is flush with surface 27. This is shown in cross section in FIG. 6 part E for one brush 10, or in FIG. 5 part F for a brush assembly 25.

By making the brush assembly 25 in this way, the end of each bristle 14 in bundle 12 is machined flush with the surface of the plate, and any remaining glue at the end of the brush is removed. This provides a full contact environment with the transmitting surface of the MFL tool or other tool in which the brush assembly will be used. Each individual bristle is therefore able to transmit an electric or magnetic signal to, or may to receive a signal from, a detector or sensor or other surface adjacent to contact surface 32. Therefore, air spaces or other irregularities in the bundle between the bristles do not interfere with the transmission of a signal from one end of a bristle to the other.

While the brush has been described in conjunction with the disclosed embodiments, it will be understood that the brush is not intended to be limited to these embodiments. On the contrary, the brush is intended to cover alternatives, modifications and equivalents, which may be included within the spirit and scope of the brush as defined by the appended claims.

We claim:

1. A pipeline pig brush assembly comprising:

at least one brush including a tubular, metal bristle holder including walls and a bore that defines a retention cavity accessible from both ends, and a bundle of unattached bristles within the retention cavity secured to the bristle holder by swaging to deform the walls of the bristle holder against the bundle of bristles, and the brush comprising a bound surface and a brush surface; and a larger metal object that has a top surface and a bottom surface and at least one hole extending into the larger metal object from the top surface, the at least one brush is secured in the at least one hole such that the brush surface extends past the top surface of the larger metal object and at least a portion of the walls of bristle holder that have been deformed by swaging is inserted in the at least one hole.

2. The pipeline pig brush assembly of claim 1 wherein the bound surface of the brush extends past the bottom surface of the larger metal object.

3. The pipeline pig brush assembly of claim 2 wherein the at least one brush further comprises a contact surface that is flush with the bottom surface of the larger metal object.

4. The pipeline pig brush assembly of claim 1 wherein the at least one hole comprises a positioning element for positioning the brush in the hole.

5. The pipeline pig brush assembly of claim 1 wherein the bundle of bristles is further secured within the retention cavity by glue.

6. The pipeline pig brush assembly of claim 1 wherein the at least one brush is secured in the at least one hole by installing the bristle holder of the at least one brush into the at least one hole by an interference fit or a transition fit between the bristle holder and the at least one hole.

7. The pipeline pig brush assembly of claim 1 wherein the at least one brush is secured in the at least one hole by installing the bristle holder of the at least one brush into the at least one hole by gluing.

8. The pipeline pig brush assembly of claim 1 wherein a portion of the at least one brush extends beyond the bottom surface of the larger metal object.

* * * * *